US011021678B2

(12) United States Patent
Saito et al.

(10) Patent No.: US 11,021,678 B2
(45) Date of Patent: Jun. 1, 2021

(54) LIQUID DETERGENT COMPOSITION FOR HARD SURFACES

(71) Applicant: KAO CORPORATION, Tokyo (JP)

(72) Inventors: Shinya Saito, Wakayama (JP); Keigo Suzuki, Wakayama (JP); Takuji Kawamura, Wakayama (JP)

(73) Assignee: KAO CORPORATION, Tokyo (JP)

( * ) Notice: Subject to any disclaimer, the term of this patent is extended or adjusted under 35 U.S.C. 154(b) by 0 days.

(21) Appl. No.: 16/609,989

(22) PCT Filed: Oct. 16, 2018

(86) PCT No.: PCT/JP2018/038394

§ 371 (c)(1),
(2) Date: Oct. 31, 2019

(87) PCT Pub. No.: WO2019/078179

PCT Pub. Date: Apr. 25, 2019

(65) Prior Publication Data

US 2020/0071637 A1 Mar. 5, 2020

(30) Foreign Application Priority Data

Oct. 17, 2017 (JP) ..... 2017-200977
Oct. 17, 2017 (JP) ..... JP2017-200976

(51) Int. Cl.

| | |
|---|---|
| ***C11D 1/75*** | (2006.01) |
| ***C11D 1/825*** | (2006.01) |
| ***B08B 3/08*** | (2006.01) |
| ***C11D 11/00*** | (2006.01) |
| ***C11D 17/00*** | (2006.01) |
| *C11D 1/66* | (2006.01) |

(52) U.S. Cl.
CPC ..... *C11D 1/825* (2013.01); *B08B 3/08* (2013.01); *C11D 11/0023* (2013.01); *C11D 17/0008* (2013.01); *C11D 1/667* (2013.01); *C11D 1/75* (2013.01)

(58) Field of Classification Search
CPC ..... C11D 1/75
See application file for complete search history.

(56) References Cited

U.S. PATENT DOCUMENTS 3,984,538 A * 10/1976 Korkis ..... A61Q 5/02 510/123
4,140,648 A * 2/1979 Thompson ..... A61K 8/046 424/47
4,154,706 A * 5/1979 Kenkare ..... A61K 8/39 510/123
4,329,334 A * 5/1982 Su ..... A61Q 5/02 424/70.19
4,329,335 A * 5/1982 Su ..... A61Q 5/006 424/70.17
4,420,484 A * 12/1983 Gorman ..... A61K 8/44 514/214.01
RE32,300 E * 12/1986 Gorman et al.
5,466,395 A 11/1995 Tosaka et al.
5,554,360 A * 9/1996 Nakamura ..... A61K 8/37 424/70.11
5,635,461 A * 6/1997 Onitsuka ..... A61Q 5/02 510/126

(Continued)

FOREIGN PATENT DOCUMENTS

CN 103228777 A 7/2013
EP 0 510 870 A2 10/1992

(Continued)

OTHER PUBLICATIONS

International Preliminary Report on Patentability and English translation of the Written Opinion of the International Searching Authority for International Application No. PCT/JP2018/038394, dated Apr. 30, 2020.
International Search Report issued in PCT/JP2018/038394 (PCT/ISA/210), dated Dec. 25, 2018.
Chinese Notification of First Office Action and Search Report (including an English translation thereof) issued in the corresponding Chinese Patent Application No. 201880030565.0 dated Aug. 26, 2020.
"Handbook of fine chemical-containing raw materials in common use", p. 320, Mar. 1998.

(Continued)

*Primary Examiner* — Charles I Boyer
(74) *Attorney, Agent, or Firm* — Birch, Stewart, Kolasch & Birch, LLP

(57) ABSTRACT

Provided is a liquid detergent composition for hard surfaces which contains (a1) an amine oxide-type surfactant having at least one alkyl group or alkenyl group with 13 or more and 18 or less carbons [hereinafter, referred to as component (a1)]; and (b1) a sorbitan fatty acid ester in which the fatty acid residue has 10 or more and 18 or less carbons [hereinafter, referred to as component (b1)]; and water, wherein the mass ratio of the content of component (a1) to the content of component (b1), (a1)/(b1), is 0.4 or more.

Also provided is a liquid detergent composition for hard surfaces which contains a surfactant in an amount of 0.1% by mass or more and 20% by mass or less; and water, wherein the liquid detergent composition contains, as the surfactant, (a2) an amine oxide-type surfactant having at least one alkyl group or alkenyl group with 7 or more and 12 or less carbons [hereinafter, referred to as component (a2)] and (b2) a glycerin fatty acid ester in which the fatty acid residue has 10 or more and 18 or less carbons [hereinafter, referred to as component (b2)], and wherein in the surfactant, the total content of the content of component (a2) and the content of component (b2) is 40% by mass or more.

4 Claims, No Drawings

(56) References Cited

U.S. PATENT DOCUMENTS

| | | | | |
|---|---|---|---|---|
| 2005/0170990 | A1* | 8/2005 | Hecht | C11D 1/83 510/417 |
| 2005/0187121 | A1* | 8/2005 | Dietz | C11D 3/162 510/242 |
| 2010/0234271 | A1* | 9/2010 | Scheuing | C11D 3/33 510/465 |
| 2013/0251648 | A1* | 9/2013 | Tong | A61Q 11/00 424/54 |
| 2014/0378550 | A1* | 12/2014 | Grundhofer | C11D 3/3776 514/643 |
| 2019/0125634 | A1* | 5/2019 | Linder | A01N 25/30 |

FOREIGN PATENT DOCUMENTS

| | | | |
|---|---|---|---|
| EP | 0 535 693 | A1 | 4/1993 |
| JP | 60-6795 | A | 1/1985 |
| JP | 5-98290 | A | 4/1993 |
| JP | 5-148494 | A | 6/1993 |
| JP | 6-33099 | A | 2/1994 |
| JP | 6-172790 | A | 6/1994 |
| JP | 2008-266375 | A | 11/2008 |
| JP | 2012-126883 | A | 7/2012 |
| JP | 2016-160350 | A | 7/2012 |
| SG | 190808 | A1 | 7/2013 |

OTHER PUBLICATIONS

"Industrial detergent and cleaning technique", pp. 223-224, Dec. 1993.

"Manufacture of non-ionic surfactant, properties and analysis thereof", p. 702, Jun. 1990.

"New edition: specification and inspection method of practical chemical products", pp. 249-250, Dec. 1995.

"Science and technology of modern cosmetic", vol. 1, p. 455, Mar. 2016.

Chinese Notification of Second Office Action (including an English translation thereof) issued in the corresponding Chinese Patent Application No. 201880030565.0 dated Mar. 22, 2021.

* cited by examiner

LIQUID DETERGENT COMPOSITION FOR HARD SURFACES

FIELD OF THE INVENTION

The present invention relates to a liquid detergent composition for hard surfaces, and a method for cleaning a hard surface.

BACKGROUND OF THE INVENTION

As kitchen detergents for articles in and around kitchens such as ranges, ovens, walls and floors around ranges, and ventilation fans, and detergents for food processing installations, detergents containing a surfactant, a solvent, an alkali agent and the like are generally used for removing oil spots degenerated under the action of heat, sunlight, oxygen in air or the like.

JP-A 2008-266375 discloses a detergent composition for hard surfaces which is excellent in detergency and sterilizing capacity, hardly damages materials of objects to be cleaned, and has a reduced environmental load, the detergent composition containing (A) a specific amine oxide and/or a specific carbobetaine-type amphoteric surfactant; (B) at least one nonionic surfactant selected from alkyl glucosides, fatty acid alkanol amides and fatty acid esters; (C) a cationic surfactant, (D) an organic acid and a salt thereof; and water (E), and the stock solution of which has a pH of 6.0 to 8.0 at 25° C. (JIS Z-8802: 1984 "pH Measurement Method").

Further, JP-A 2016-160350 discloses a sterilizing detergent composition for a food processing installation or a cooking utensil which develops a reliable sterilizing effect even in a food processing installation or a cooking utensil having very small spaces where it is difficult to reduce the number of bacterial with conventional sterilizing detergents, and which retains an antibacterial effect even after rinsing, the sterilizing detergent composition containing two or more basic polypeptides (A) and surfactant (B), and having a pH of 10 or more at 20° C.

Further, JP-A 2012-126883 discloses a detergent composition for hard surfaces which is excellent in detergency against cooking oil spots, the detergent composition containing (a) a monoalkyl ether of a polyalkylene glycol; (b) an amine oxide; (c) 0.001 to 15% by mass of one or more kinds selected from the group consisting of a fatty acid having 8 to 18 carbons and a salt thereof; and water, wherein the mass ratio of component (c)/(component (b)+component (c)) is 0.001/1 to 1/1, and a monoalkyl ether of dipropylene glycol with the alkyl group having 4 to 8 carbons constitutes 60 to 100% by mass of component (a), the detergent composition having a pH of 8 to 14 at 25° C., wherein a uniform liquid composition can be formed using as little surfactant as possible.

Further, JP-A 5-98290 discloses a milky liquid detergent composition for hard surfaces which is excellent in not only cleaning properties and foaming properties but also feeling of use, and does not roughen hands, the detergent composition containing (a) 1 to 40% by weight of an anionic surfactant; (b) 1 to 20% by weight of a specific tertiary amine oxide; and (c) 1 to 20% by weight of a glycerin fatty acid ester in which the fatty acid residue has 16 to 24 carbons and the content ratio of monoglyceride is 75 to 100%, wherein (a)+(b) is 5 to 40% by weight, and the weight ratio of (c)/[ (a)+(b)] is 0.05 to 1.

Further, JP-A 5-148494 discloses a milky liquid detergent composition for hard surfaces which is excellent in cleaning properties and foaming properties, prevents redeposition of contaminants, does not roughen hands, and gives a good feeling to hand skin after cleaning, the detergent composition containing (a) 1 to 50% by weight of an alkyl glycoside, and (b) 1 to 30% by weight of one or more compounds selected from the group consisting of (b-1) a lipid selected from a hydrocarbon, a higher alcohol, a fatty acid, a wax, a cholesterol and a cholesterol ester and having a melting point of 30° C. or higher, (b-2) a partial ester of an aliphatic hydrocarbon polyol having 2 to 9 carbons with a fatty acid having an average number of carbons of 13 or more, the partial ester having a melting point of 30° C. or higher, and (b-3) a partial ether of an aliphatic hydrocarbon polyol having 2 to 9 carbons with a fatty acid hydrocarbon having an average number of carbons of 13 or more, the partial ether having a melting point of 30° C. or higher, wherein the blending ratio of component (b) to component (a), ((b)/(a)), is 1/10 to 10/1 in terms of a weight ratio.

SUMMARY OF THE INVENTION

As kitchen detergents and detergents for food processing installations, detergents capable of removing oil spots including a degenerated oil, particularly oil spots including a thermally degenerated oil are desired.

JP-A 2008-266375 discloses a detergent composition containing a specific amine oxide-type surfactant and a sorbitan fatty acid ester at a specific ratio, but does not suggest that the detergent composition has an excellent detergent effect against degenerated oil spots. Further, JP-A 5-98290 and JP-A 5-148494 disclose a detergent composition which contains an amine oxide-type surfactant and a glycerin fatty acid ester and which is gentle to the skin, but another active agent is used as a main detergent base material, and it is not suggested that a detergent composition having an amine oxide-type surfactant and a glycerin fatty acid ester as main base materials has an excellent detergent effect against degenerated oil spots.

The present invention relates to a liquid detergent composition for hard surfaces which is excellent in detergency against oil spots including a degenerated oil such as a thermally degenerated oil (hereinafter, also referred to simply as detergency); and a method for cleaning a hard surface using the liquid detergent composition for hard surfaces.

In the specification of the present application, the degenerated oil is an oil including oil components degenerated under the action of heat, sunlight, oxygen in air or the like. The thermally degenerated oil is an oil degenerated by heat, and includes oil components oxidized by heat.

The present invention relates to a liquid detergent composition for hard surfaces which contains (a1) an amine oxide-type surfactant having at least one alkyl group or alkenyl group with 13 or more and 18 or less carbons [hereinafter, referred to as component (a1)]; and (b1) a sorbitan fatty acid ester in which the fatty acid residue has 10 or more and 18 or less carbons [hereinafter, referred to as component (b1)]; and water, wherein the mass ratio of the content of component (a1) to the content of component (b1), (a1)/(b1), is 0.4 or more. Hereinafter, the liquid detergent composition for hard surfaces is referred to as a first aspect of the present invention.

The present invention also relates to a liquid detergent composition for hard surfaces which contains a surfactant in an amount of 0.1% by mass or more and 20% by mass or less; and water, wherein the liquid detergent composition contains, as the surfactant, (a2) an amine oxide-type surfactant having at least one alkyl group or alkenyl group with 7 or more and 12 or less carbons [hereinafter, referred to as component (a2)] and (b2) a glycerin fatty acid ester in which the fatty acid residue has 10 or more and 18 or less carbons [hereinafter, referred to as component (b2)], and wherein in the surfactant, the total content of the content of component (a2) and the content of component (b2) is 40% by mass or more. Hereinafter, the liquid detergent composition for hard surfaces is referred to as a second aspect of the present invention.

The present invention also relates to a method for cleaning a hard surface in which the liquid detergent composition for hard surfaces is contacted with a hard surface stained with oil spots including a degenerated oil.

The present invention provides a liquid detergent composition for hard surfaces which is excellent in detergency against oil spots including a degenerated oil such as a thermally degenerated oil; and a method for cleaning a hard surface in which oil spots adhered to a hard surface and including a degenerated oil such as a thermally degenerated oil are removed with the liquid detergent composition for hard surfaces.

Embodiments of the Invention

[Liquid Detergent Composition for Hard Surfaces]

A thermally degenerated oil has high viscosity because it is considered to include oil components with oil components partially changed to polar groups by oxidation of an oil by heat, dimerized or trimerized oil components, or high-molecular-weight oil components subjected to sequentially proceeding oxidation reaction. Removal of such a thermally degenerated oil having high viscosity is considered to require that a surfactant infiltrate the thermally degenerated oil, and emulsify or solubilize the oil. Although the reason why the liquid detergent composition for hard surfaces according to the present invention is excellent in detergency against oil spots including a degenerated oil, particularly a thermally degenerated oil, is not necessarily evident, it is presumed that by using either one of a combination of component (a1) and component (b1) and a combination of component (a2) and component (b2) in the present invention, infiltration into a thermally degenerated oil can be facilitated to effectively perform emulsification or the like of the thermally degenerated oil, and thus a high detergent effect is obtained.

[First Aspect]

The first aspect of the present invention is a liquid detergent composition for hard surfaces which contains (a1) an amine oxide-type surfactant having at least one alkyl group or alkenyl group with 13 or more and 18 or less carbons [hereinafter, referred to as component (a1)]; and (b1) a sorbitan fatty acid ester in which the fatty acid residue has 10 or more and 18 or less carbons [hereinafter, referred to as component (b1)]; and water, wherein the mass ratio of the content of component (a1) to the content of component (b1), (a1)/(b1), is 0.4 or more.

<Component (a1)>

Component (a1) in the present invention is an amine oxide-type surfactant having at least one alkyl group or alkenyl group with 13 or more and 18 or less carbons. From the viewpoint of detergency, component (a1) is preferably an amine oxide having one alkyl group or alkenyl group with 13 or more and 18 or less carbons, more preferably an amine oxide having one alkyl group with 13 or more and 18 or less carbons, further preferably an amine oxide having one alkyl group with 13 or more and 16 or less carbons, furthermore preferably an amine oxide having one alkyl group with 14 carbons.

From the viewpoint of detergency, component (a1) is suitably a compound represented by general formula (a1) below.

[Formula 1]

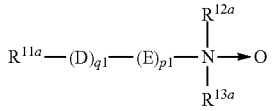

(a1)

wherein $R^{11a}$ represents an alkyl group or an alkenyl group having 13 or more and 18 or less carbons, $R^{12a}$ and $R^{13a}$ each independently represent an alkyl group having 1 or more and 3 or less carbons; D represents a —NHC(=O)—group or a —C(=O)NH— group, and E represents an alkylene group having 1 or more and 5 or less carbons; and q1 and p1 represent that q1=0 and p1=0, or q1=1 and p1=1.

When q1=1 and p1=1, and D is a —C(=O)NH— group in general formula (a1) above, $R^{11a}$ is preferably an alkyl group having 13 or more and 17 or less carbons, more preferably an alkyl group having 13 or more and 15 or less carbons, further preferably an alkyl group having 13 carbons from the viewpoint of detergency. When q1=1 and p1=1, and D is a —NHC(=O)— group, or when q1=0 and p1=0, $R^{11a}$ is preferably an alkyl group having 14 or more and 18 or less carbons, more preferably an alkyl group having 14 or more and 16 or less carbons, further preferably an alkyl group having 14 carbons from the viewpoint of detergency. From the viewpoint of detergency, each of $R^{12}$a and $R^{13a}$ is preferably a methyl group having 1 carbon. From the viewpoint of detergency, q1 and p1 are preferably q=0 and p=0.

Preferred specific examples of component (a1) include (1) alkyl (14 or more and 18 or less carbons) dialkyl (1 or more and 3 or less carbons) amine oxides or alkenyl (14 or more and 18 or less carbons) dialkyl (1 or more and 3 or less carbons) amine oxides such as myristyl dimethylamine oxide, stearyl dimethylamine oxide and oleyl dimethylamine oxide; and (2) fatty acid (14 or more and 18 or less carbons) amidopropyl dialkyl (1 or more and 3 or less carbons) amine oxides such as myristic acid amidopropyl dimethylamine oxide, and from the viewpoint of detergency, (1) alkyl (14 or more and 18 or less carbons) dialkyl (1 or more and 3 or less carbons) amine oxides or alkenyl (14 or more and 18 or less carbons) dialkyl (1 or more and 3 or less carbons) amine oxides are more preferable.

The liquid detergent composition for hard surfaces according to the present invention contains component (a1) in an amount of preferably 0.01% by mass or more, more preferably 0.05% by mass or more, further preferably 0.1% by mass or more, furthermore preferably 0.2% by mass or more, furthermore preferably 0.3% by mass or more, furthermore preferably 0.5% by mass or more from the viewpoint of detergency, and preferably 20% by mass or less, more preferably 10% by mass or less, further preferably 8% by mass or less, furthermore preferably 6% by mass or less, furthermore preferably 5% by mass or less, furthermore preferably 4% by mass or less, furthermore preferably 2% by mass or less from the viewpoint of blending stability.

The liquid detergent composition for hard surfaces according to the present invention may contain amine oxide-type surfactants other than component (a1) within a range that does not impair the effects of the present invention.

From the viewpoint of detergency, the content of component (a1) is preferably 50% by mass or more, more preferably 70% by mass or more, further preferably 80% by mass or more, furthermore preferably 90% by mass or more, and preferably 100% by mass or less, or may be 100% by mass in the amine oxide having at least one alkyl group or alkenyl group with 8 or more and 24 or less carbons in the liquid detergent composition for hard surfaces according to the present invention. Here, the amine oxide having at least one alkyl group or alkenyl group with 8 or more and 24 or less carbons preferably has the same structure except that $R^{11a}$ is an alkyl group or an alkenyl group having 8 or more and 24 or less carbons in general formula (a1) above.

<Component (b1)>

Component (b1) in the present invention is a sorbitan fatty acid ester in which the fatty acid residue has 10 or more and 18 or less carbons. In the present invention, the fatty acid residue is a carboxyl group of a raw material fatty acid from which the OH group is removed.

In component (b1), the ester structure of sorbitan and the fatty acid may be one or more selected from a triester structure, a diester structure and a monoester structure.

In component (b1), the number of carbons in the fatty acid residue is 10 or more, preferably 12 or more, more preferably 14 or more, further preferably 16 or more, and 18 or less, further preferably 18 from the viewpoint of detergency.

In component (b1), the raw material fatty acid for the fatty acid residue may be one or more kinds selected from oleic acid, stearic acid, linoleic acid, linolenic acid, palmitic acid, myristic acid, lauric acid and capric acid, and is preferably one or more kinds selected from oleic acid, stearic acid, palmitic acid, myristic acid and lauric acid, more preferably one or more kinds selected from oleic acid, stearic acid and palmitic acid, further preferably one or more kinds selected from oleic acid and stearic acid from the viewpoint of detergency. Further, the raw material fatty acid for the fatty acid residue may be a mixed fatty acid derived from a vegetable oil such as a palm oil or an olive oil or an animal oil such as tallow or lard.

From the viewpoint of detergency, component (b1) is further preferably one or more kinds selected from a monoester structure of sorbitan and a fatty acid in which the fatty acid residue has 16 or more and 18 or less carbons, particularly 18 carbons; and a triester structure of sorbitan and a fatty acid in which the fatty acid residue has 16 or more and 18 or less carbons, particularly 18 carbons.

The liquid detergent composition for hard surfaces according to the present invention contains component (b1) in an amount of preferably 0.01% by mass or more, more preferably 0.05% by mass or more, further preferably 0.1% by mass or more, furthermore preferably 0.2% by mass or more, furthermore preferably 0.3% by mass or more, furthermore preferably 0.5% by mass or more from the viewpoint of detergency, and preferably 20% by mass or less, more preferably 10% by mass or less, further preferably 8% by mass or less, furthermore preferably 6% by mass or less, furthermore preferably 5% by mass or less, furthermore preferably 4% by mass or less, furthermore preferably 2% by mass or less from the viewpoint of blending stability.

The liquid detergent composition for hard surfaces according to the present invention may contain sorbitan fatty acid esters other than component (b1) within a range that does not impair the effects of the present invention. From the viewpoint of detergency, the content of component (b1) is 50% by mass or more, preferably 60% by mass or more, more preferably 70% by mass or more, further preferably 80% by mass or more, furthermore preferably 90% by mass or more, and preferably 100% by mass or less, or may be 100% by mass in the sorbitan fatty acid ester in which the fatty acid residue has 8 or more and 24 or less carbons in the liquid detergent composition for hard surfaces according to the present invention.

In the liquid detergent composition for hard surfaces according to the present invention, the mass ratio of the content of component (a1) to the content of component (b1), (a1)/(b1), is 0.4 or more, preferably 0.6 or more, more preferably 0.7 or more, further preferably 0.8 or more from the viewpoint of detergency, and preferably 20 or less, more preferably 15 or less, further preferably 12 or less, furthermore preferably 10 or less, furthermore preferably 8 or less, furthermore preferably 7 or less from the same viewpoint.

In the liquid detergent composition for hard surfaces according to the present invention, the total content of the content of component (a1) and component (b1) is preferably 0.02% by mass or more, more preferably 0.1% by mass or more, further preferably 0.5% by mass or more, furthermore preferably 0.8, furthermore preferably 1% by mass or more from the viewpoint of detergency, and preferably 40% by mass or less, more preferably 30% by mass or less, furthermore preferably 20% by mass or less, furthermore preferably 10% by mass or less, furthermore preferably 5% by mass or less, furthermore preferably 4% by mass or less, furthermore preferably 2% by mass or less, furthermore preferably 1.5% by mass or less from the viewpoint of blending stability.

The liquid detergent composition for hard surfaces according to the present invention may contain a surfactant other than component (a1) and component (b1) within a range that does not impair the effects of the present invention. As the surfactant other than component (a1) and component (b1), it is possible to use alkyl glycoside-type surfactants in which the alkyl group has 10 or more and 16 or less, preferably 14 or less carbons, and polyoxyethylene alkyl ether-type surfactants in which the alkyl group has 8 or more, preferably 10 or more, and 16 or less, preferably 14 or less carbons and the average number of added moles of an oxyethylene group is 3 or more, preferably 5 or more, and 30 or less, preferably 12 or less, and from the viewpoint of detergency, alkyl glycoside-type surfactants in which the alkyl group has 10 or more and 14 or less carbons are preferable. From the viewpoint of detergency, the content of the surfactant other than component (a1) and component (b1) is preferably less than 5% by mass, more preferably less than 3% by mass, further preferably less than 1% by mass, or may be 0% by mass in the liquid detergent composition for hard surfaces according to the present invention.

From the viewpoint of detergency, the total content of the content of component (a1) and the content of component (b1) is preferably 50% by mass or more, more preferably 60% by mass or more, further preferably 80% by mass or more, furthermore preferably 90% by mass or more, and preferably 100% by mass or less, or may be 100% by mass in all surfactants in the liquid detergent composition for hard surfaces according to the present invention. That is, the liquid detergent composition for hard surfaces according to the present invention may be a liquid detergent composition for hard surfaces which contains a surfactant and water, the liquid detergent composition containing component (a1) and component (b1) as the surfactant, wherein in the surfactant, the total content of the content of component (a1) and component (b1) is 50% by mass or more.

[Second Aspect]

The second aspect of the present invention is a liquid detergent composition for hard surfaces which contains a surfactant in an amount of 0.1% by mass or more and 20% by mass or less; and water, wherein the liquid detergent composition contains, as the surfactant, (a2) an amine oxide-type surfactant having at least one alkyl group or alkenyl group with 7 or more and 12 or less carbons [hereinafter, referred to as component (a2)] and (b2) a glycerin fatty acid ester in which the fatty acid residue has 10 or more and 18 or less carbons [hereinafter, referred to as component (b2)], and wherein in the surfactant, the total content of the content of component (a2) and the content of component (b2) is 40% by mass or more.

<Surfactant>

The liquid detergent composition for hard surfaces according to the present invention contains component (a2) and component (b2) as the surfactant. The liquid detergent composition for hard surfaces according to the present invention contains the surfactant in an amount of 0.1% by mass or more, preferably 0.5% by mass or more, more preferably 1% by mass or more, further preferably 2% by mass or more, furthermore preferably 2.5% by mass or more from the viewpoint of detergency, and 20% by mass or less, preferably 15% by mass or less, more preferably 10% by mass or less, further preferably 8% by mass or less, furthermore preferably 6% by mass or less, furthermore preferably 4% by mass or less from the viewpoint of blending stability.

<Component (a2)>

Component (a2) in the present invention is an amine oxide-type surfactant having at least one alkyl group or alkenyl group with 7 or more and 12 or less carbons. From the viewpoint of detergency, component (a2) is preferably an amine oxide having one alkyl group or alkenyl group with 7 or more and 12 or less carbons, more preferably an amine oxide having one alkyl group with 7 or more and 12 or less carbons, further preferably an amine oxide having one alkyl group with 9 or more and 12 or less carbons, furthermore preferably an amine oxide having one alkyl group with 12 carbons.

From the viewpoint of detergency, component (a2) is suitably a compound represented by general formula (a2) below.

[Formula 2]

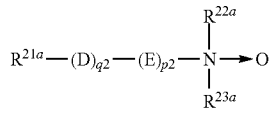

(a2)

wherein $R^{21a}$ represents an alkyl group or an alkenyl group having 7 or more and 12 or less carbons, $R^{22a}$ and $R^{23a}$ each independently represent an alkyl group having 1 or more and 3 or less carbons; D represents a —NHC(=O)— group or a —C(=O)NH— group, and E represents an alkylene group having 1 or more and 5 or less carbons; and q2 and p2 represent that q2=0 and p2=0, or q2=1 and p2=1.

When q2=0 and p2=0, and D is a —C(=O)NH— group in general formula (a2) above, $R^{21a}$ is an alkyl group having 7 or more and 11 or less carbons, more preferably an alkyl group having 9 or more and 11 or less carbons, further preferably an alkyl group having 11 carbons from the viewpoint of detergency. When q2=1 and p2=1, and D is a —NHC(=O)— group, or when q2=0 and p2=0, $R^{21a}$ is preferably an alkyl group having 8 or more and 12 or less carbons, more preferably an alkyl group having 10 or more and 12 or less carbons, further preferably an alkyl group having 12 carbons from the viewpoint of detergency. From the viewpoint of detergency, each of $R^{22a}$ and $R^{23a}$ is preferably a methyl group having 1 carbon. From the viewpoint of detergency, q2 and p2 are preferably q2=0 and p2=0.

Preferred specific examples of component (a2) include (1) alkyl (8 or more and 12 or less carbons) dialkyl (1 or more and 3 or less carbons) amine oxides or alkenyl (8 or more and 12 or less carbons) dialkyl (1 or more and 3 or less carbons) amine oxides such as lauryl dimethylamine oxide, decyl dimethylamine oxide and octyl dimethylamine oxide; and (2) fatty acid (8 or more and 12 or less carbons) amidepropyl dialkyl (1 or more and 3 or less carbons) amine oxides such as lauric acid amidopropyl dimethylamine oxide, and from the viewpoint of detergency, (1) alkyl (8 or more and 12 or less carbons) dialkyl (1 or more and 3 or less carbons) amine oxides or alkenyl (8 or more and 12 or less carbons) dialkyl (1 or more and 3 or less carbons) amine oxides are more preferable.

The liquid detergent composition for hard surfaces according to the present invention contains component (a2) in an amount of preferably 0.05% by mass or more, more preferably 0.25% by mass or more, further preferably 0.5% by mass or more, furthermore preferably 1% by mass or more, furthermore preferably 1.25% by mass or more from the viewpoint of detergency, and preferably 10% by mass or less, more preferably 7.5% by mass or less, further preferably 5% by mass or less, furthermore preferably 4% by mass or less, furthermore preferably 3% by mass or less, furthermore preferably 2% by mass or less from the viewpoint of blending stability.

The liquid detergent composition for hard surfaces according to the present invention may contain amine oxide-type surfactants other than component (a2) within a range that does not impair the effects of the present invention. From the viewpoint of detergency, the content of component (a2) is preferably 50% by mass or more, more preferably 70% by mass or more, further preferably 80% by mass or more, furthermore preferably 90% by mass or more, and preferably 100% by mass or less, or may be 100% by mass in the amine oxide having at least one alkyl group or alkenyl group with 8 or more and 24 or less carbons in the liquid detergent composition for hard surfaces according to the present invention. Here, the amine oxide having at least one alkyl group or alkenyl group with 8 or more and 24 or less carbons preferably has the same structure except that $R^{21a}$ is an alkyl group or an alkenyl group having 8 or more and 24 or less carbons in general formula (a2) above.

<Component (b2)>

Component (b2) in the present invention is a glycerin fatty acid ester in which the fatty acid residue has 10 or more and 18 or less carbons. In the present invention, the fatty acid residue is a carboxyl group of a raw material fatty acid from which the OH group is removed.

In component (b2), exemplified as the ester structure of glycerin and the fatty acid is one or more kinds selected from a triester structure, a diester structure and a monoester structure; and a monoester structure is preferable.

In component (b2), the number of carbons in the fatty acid residue is 10 or more, preferably 12 or more, more preferably 14 or more, and 18 or less, further preferably 18 from the viewpoint of detergency.

In component (b2), exemplified as the raw material fatty acid for the fatty acid residue is one or more kinds selected from oleic acid, stearic acid, linoleic acid, palmitic acid, myristic acid, lauric acid and capric acid, and from the viewpoint of detergency, preferable is one or more kinds selected from oleic acid, palmitic acid, myristic acid and lauric acid and capric acid, more preferable is one or more kinds selected from oleic acid, palmitic acid and myristic acid, further preferable is one or more kinds selected from oleic acid and palmitic acid, and furthermore preferable is oleic acid. Further, the raw material fatty acid for the fatty acid residue may be a mixed fatty acid derived from a vegetable oil such as a palm oil or an olive oil or an animal oil such as tallow or lard.

The liquid detergent composition for hard surfaces according to the present invention contains component (b2) in an amount of preferably 0.05% by mass or more, more preferably 0.25% by mass or more, further preferably 0.5% by mass or more, furthermore preferably 1% by mass or more, furthermore preferably 1.25% by mass or more from the viewpoint of detergency, and preferably 10% by mass or less, more preferably 7.5% by mass or less, further preferably 5% by mass or less, furthermore preferably 4% by mass or less, furthermore preferably 3% by mass or less, furthermore preferably 2% by mass or less from the viewpoint of blending stability.

The liquid detergent composition for hard surfaces according to the present invention may contain glycerin fatty acid esters other than component (b2) within a range that does not impair the effects of the present invention. From the viewpoint of detergency, the content of component (b2) is 50% by mass or more, preferably 60% by mass or more, more preferably 70% by mass or more, further preferably 80% by mass or more, furthermore preferably 90% by mass or more, and preferably 100% by mass or less, or may be 100% by mass in the glycerin fatty acid ester in which the fatty acid residue has 8 or more and 24 or less carbons in the liquid detergent composition for hard surfaces according to the present invention.

In the liquid detergent composition for hard surfaces according to the present invention, the mass ratio of the content of component (a2) to the content of component (b2), (a2)/(b2), is preferably 0.4 or more, more preferably 0.7 or more, further preferably 1 or more, from the viewpoint of detergency, and preferably 20 or less, more preferably 15 or less, further preferably 12 or less, furthermore preferably 10 or less, furthermore preferably 8 or less, furthermore preferably 7 or less, furthermore preferably 5 or less, furthermore preferably 2 or less from the same viewpoint.

In the liquid detergent composition for hard surfaces according to the present invention, the total content of the content of component (a2) and the content of component (b2) is preferably 0.1% by mass or more, more preferably 0.5% by mass or more, further preferably 1% by mass or more, furthermore preferably 1.5% by mass or more, furthermore preferably 2% by mass or more, furthermore preferably 2.5% by mass or more from the viewpoint of detergency, and preferably 20% by mass or less, more preferably 15% by mass or less, further preferably 10% by mass or less, furthermore preferably 8% by mass or less, furthermore preferably 6% by mass or less, furthermore preferably 4% by mass or less from the viewpoint of blending stability.

The liquid detergent composition for hard surfaces according to the present invention may contain a surfactant other than component (a2) and component (b2) within a range that does not impair the effects of the present invention. As the surfactant other than component (a2) and component (b2), it is possible to use alkyl glycoside-type surfactants in which the alkyl group has 10 or more and 16 or less, preferably 14 or less carbons, and polyoxyethylene alkyl ether-type surfactants in which the alkyl group has 8 or more, preferably 10 or more, and 16 or less, preferably 14 or less carbons and the average number of added moles of an oxyethylene group is 3 or more, preferably 5 or more, and 30 or less, preferably 12 or less, and from the viewpoint of detergency, alkyl glycoside-type surfactants in which the alkyl group has 10 or more and 14 or less carbons are preferable. From the viewpoint of detergency, the content of the surfactant other than component (a2) and component (b2) is preferably less than 5% by mass, more preferably less than 3% by mass, further preferably less than 1% by mass, or may be 0% by mass in the liquid detergent composition for hard surfaces according to the present invention.

From the viewpoint of detergency, the total content of the content of component (a2) and the content of component (b2) in surfactants, [(((a2)+b2))/surfactant)×100] is 40% by mass or more, preferably 50% by mass or more, more preferably 60% by mass or more, further preferably 80% by mass or more, furthermore preferably 90% by mass or more, and preferably 100% by mass or less, or may be 100% by mass in the liquid detergent composition for hard surfaces according to the present invention.

Hereinafter, common matters of the first aspect and the second aspect of the present invention will be described.

<Component (c)>

In the liquid detergent composition for hard surfaces according to the present invention, preferably, a compound represented by general formula (c1) below is contained as component (c) from the viewpoint of foaming properties.

$$R^{1c}—O—(R^{2c}O)_t—H \quad (c1)$$

wherein $R^{1c}$ is a hydrocarbon group having 1 or more and 8 or less carbons, $R^{2c}O$ is an alkyleneoxy group having 2 or more and 3 or less carbons, and t is the number of added moles of $R^{2c}O$, and a number of 1 or more and 3 or less.

From the viewpoint of foaming properties and odor, $R^{1c}$ in general formula (c1) is a hydrocarbon group having 1 or more, preferably 2 or more, and 8 or less, preferably 6 or less, more preferably 5 or less, further preferably 4 or less carbons. From the viewpoint of foaming properties, $R^{1c}$ is a hydrocarbon group, preferably an alkyl group, an alkenyl group, an aryl group or an aralkyl group, more preferably an alkyl group, an aralkyl group or an aryl group, further preferably an alkyl group. From the viewpoint of foaming properties, $R^{2c}O$ is an alkyleneoxy group having 2 or more and 3 or less carbons, preferably an ethyleneoxy group or a propyleneoxy group. From the viewpoint of foaming properties, t is 1 or more, preferably 2 or more, and 3 or less.

Specific examples of component (c) include one or more kinds selected from 2-(2-n-butoxyethoxy)ethanol, 1-methoxy-2-propanol, dipropylene glycol monomethyl ether, 2-(2-hexyloxyethoxy)ethanol, 2-phenoxyethanol, 2-ethoxyethanol, 2-(2-ethoxyethoxy)ethanol, ethylene glycol monobutyl ether, triethylene glycol monobutyl ether, 1-butoxy-2-propanol, dipropylene glycol monobutyl ether, 2-isobutoxyethanol, 2-(2-isobutoxyethoxy)ethanol and ethylene glycol mono(2-ethylhexyl)ether. From the viewpoint of foaming properties, component (c) is preferably one or more kinds selected from dipropylene glycol monomethyl ether, ethylene glycol monobutyl ether, 2-(2-n-butoxyethoxy)ethanol, triethylene glycol monobutyl ether, 1-butoxy-2-propanol, dipropylene glycol monobutyl ether, 2-(2-hexyloxyethoxy)ethanol, 2-phenoxyethanol, 2-isobutoxyethanol, 2-(2-isobutoxyethoxy)ethanol and ethylene glycol mono(2-ethylhexyl)ether, more preferably one or more kinds selected from dipropylene glycol monomethyl ether, ethylene glycol monobutyl ether, 2-(2-n-butoxyethoxy) ethanol, triethylene glycol monobutyl ether and 2-(2-isobutoxyethoxy)ethanol.

In the liquid detergent composition for hard surfaces according to the present invention, component (c) is contained in an amount of preferably 0.3% by mass or more, more preferably 0.5% by mass or more, further preferably 0.7% by mass or more, furthermore preferably 1% by mass or more from the viewpoint of foaming properties, and preferably 15% by mass or less, more preferably 10% by mass or less, further preferably 5% by mass or less, furthermore preferably 4% by mass or less, furthermore preferably 3% by mass or less, furthermore preferably 2% by mass or less from the viewpoint of cleaning properties.

In the detergent composition for hard surfaces according to the first aspect of the present invention, the mass ratio of the total content of component (a1) and component (b1) to the content of component (c), [(a1)+(b1)]/(c), is preferably 1 or more, more preferably 3 or more, further preferably 5 or more from the viewpoint of cleaning properties, and preferably 30 or less, more preferably 20 or less, further preferably 10 or less from the viewpoint of foaming properties.

In the detergent composition for hard surfaces according to the second aspect of the present invention, the mass ratio of the total content of component (a2) and component (b2) to the content of component (c), [(a2)+(b2)]/(c), is preferably 1 or more, more preferably 3 or more, further preferably 5 or more from the viewpoint of cleaning properties, and preferably 40 or less, more preferably 30 or less, further preferably 20 or less, furthermore preferably 10 or less from the viewpoint of foaming properties.

<Other components>

In addition to component (a1), component (b1) and optional component (c) in the first aspect of the present invention, and component (a2), component (b2) and optional component (c) in the second aspect of the present invention, other components such as contaminant redeposition preventing agents such as acrylic acid-maleic acid copolymers or salts thereof, methacrylic acid-maleic acid copolymers or salts thereof and diisobutylene-maleic acid copolymers or salts thereof; chelating agents such as EDTA, MGDA and citric acid; and solvents, hydrotropic agents, dispersants, pH adjusters, thickeners, viscosity adjusters, perfumes, colorants, antioxidants, preservatives, bleaching agents and bleaching activators may be blended in the liquid detergent composition for hard surfaces according to the present invention in a range that does not impair the objects of the present invention.

The liquid detergent composition for hard surfaces according to the present invention contains water. That is, water is the balance after removal of component (a1), component (b1) and optional components in the first aspect of the present invention, or the balance after removal of component (a2), component (b2) and optional components in the second aspect of the present invention. In the liquid detergent composition for hard surfaces according to the present invention, water is contained in an amount of preferably 60% by mass or more, more preferably 70% by mass or more, further preferably 80% by mass or more, furthermore preferably 90% by mass or more from the viewpoint of handling properties, and preferably 99.9% by mass or less, more preferably 99.5% by mass or less, further preferably 99% by mass or less from the viewpoint of detergency. Preferably, ion-exchanged water, sterilized ion-exchanged water or the like is used.

The liquid detergent composition for hard surfaces according to the present invention has a pH preferably in a neutral range at 25° C. as measured by a glass electrode method. From the viewpoint of ease of handling, the pH is preferably 5 or more, more preferably 5.5 or more, further preferably 6 or more, and preferably 9 or less, more preferably 8.5 or less, further preferably 8 or less.

Preferably, the liquid detergent composition for hard surfaces according to the present invention is intended for hard surfaces of a hard article, and moreover a hard surface of a food processing installation or a cooking installation. The "food processing installation and/or cooking installation" means equipment and installations that are used in processing and/or cooking of foods in food processing plants. Examples of the equipment include food manufacturing or cooking equipment such as pipes, components, conveyor belts, fryers, freezers, slicers and rice mill machines. Further, examples of the installations include floors, walls and workbenches. Specifically, the liquid detergent composition for hard surfaces according to the present invention is preferably a detergent to be applied to a hard surface of a hard article, more preferably a detergent to be applied to a hard surface of a food processing installation or a cooking installation. Further, specifically, the liquid detergent composition for hard surfaces according to the present invention is preferably a detergent to be sprayed to a hard surface of a hard article, more preferably a detergent to be sprayed to a hard surface of a food processing installation or a cooking installation.

Examples of the hard articles include food manufacturing equipment such as pipes and components, and hard articles in and around kitchens. The hard articles in and around kitchens are articles that are used in and around kitchens, and specific examples thereof include:

(1) facilities for storage of food, eating utensils and cooking utensils, such as refrigerators and cupboards;

(2) food cooking facilities such as drainage conduits, cooking tables, cooking range hoods, sinks, burners and microwave ovens; and (3) floors and walls around the above facilities, and dining tables, floors, walls, tatami mats, posts, slippers and the like in and around dining halls and dining rooms. In the present invention, the above-mentioned articles are referred to as "hard articles in and around kitchens" for the sake of convenience. Further, examples of the materials of hard surfaces to be cleaned in the present invention, and moreover hard surfaces in and around kitchens, include plastics (including silicone resins), metals, ceramics, wood and combinations thereof.

<Method for Cleaning Hard Surface>

The method for cleaning a hard surface according to the present invention is a method for cleaning a hard surface in which the liquid detergent composition for hard surfaces according to the first aspect, or the liquid detergent composition for hard surfaces according to the second aspect of the present invention is contacted with a hard surface. The preferred aspect of the composition is the same as that of the above-described liquid detergent composition for hard surfaces according to the first aspect, and liquid detergent composition for hard surfaces according to the second aspect of the present invention. Hereinafter, common matters of the methods for cleaning a hard surface using the liquid detergent compositions for hard surfaces according to the first aspect or the second aspect of the present invention will be described.

The method for cleaning a hard surface according to the present invention can be suitably carried out as a method for cleaning a hard surface in which the liquid detergent composition for hard surfaces according to the present invention is contacted with a hard surface stained with oil spots including a degenerated oil, particularly a thermally degenerated oil. The method is a method for cleaning a hard surface in which the liquid detergent composition for hard surfaces according to the present invention is contacted with oil spots adhered to a hard surface and including a degenerated oil, particularly a thermally degenerated oil.

In the method for cleaning a hard surface according to the present invention, the liquid detergent composition for hard surfaces is contacted with a hard surface. Specifically, the method is preferably a cleaning method in which the liquid detergent composition for hard surfaces is contacted with a hard surface as a stock solution, or the liquid detergent composition for hard surfaces is contacted with a hard surface as a stock solution without being diluted, that is, the liquid detergent composition for hard surfaces is contacted with a hard surface without being diluted. Further, the method is a cleaning method in which the liquid detergent composition for hard surfaces is contacted with a hard surface stained with oil spots including a degenerated oil, particularly a thermally degenerated oil, without being diluted.

However, a concentrated composition containing component (a1) and component (b1), or component (a2) and component (b2) in the present invention may be prepared, followed by diluting the concentrated composition with water to prepare the liquid detergent composition for hard surfaces according to the present invention, and contacting the composition with a hard surface. That is, the method may be a method for cleaning a hard surface in which a concentrated composition containing component (a1) and component (b1) or component (a2) and component (b2) in the present invention is diluted with water to prepare the liquid detergent composition for hard surfaces according to the present invention, and the liquid detergent composition is contacted with a hard surface. Further, the method may be a method for cleaning a hard surface in which the liquid detergent composition for hard surfaces is contacted with a hard surface without being diluted.

Further, the method for cleaning a hard surface according to the present invention is a cleaning method in which the liquid detergent composition for hard surfaces is contacted with a hard surface, and the hard surface is then left standing without exerting (applying) an external force such as a mechanical force. That is, the method for cleaning a hard surface is a cleaning method in which the composition is contacted with the hard surface without use of a flexible material such as a sponge, fingers or the like, and the hard surface is left standing without exerting an external force such as a mechanical force. This method is suitable for cleaning portions unreachable or details hardly reachable with hands or tools. The phrase "left standing without exerting an external force such as a mechanical force" means that for example, intentional operation for cleaning is not carried out except for contact of the composition. For example, the phrase "left standing without exerting an external force such as a mechanical force" can be understood to include cases where the composition contacted with the hard surface naturally flows down along the hard surface and where vibrations that are not intended for cleaning propagate to the hard surface. After being left standing, the hard surface is usually rinsed with water. At the time of rinsing the hard surface, an external force (physical force) may be exerted with a hand or the like, or the hard surface may be rinsed simply with a water flow.

In the method for cleaning a hard surface according to the present invention, the liquid detergent composition for hard surfaces is contacted with a hard surface as a target at a ratio in which the amount of the composition is preferably 0.1 g or more, more preferably 0.3 g or more, further preferably 0.4 g or more, and preferably 5 g or less, more preferably 3 g or less, further preferably 2 g or less per 100 $cm^2$ of the area of the hard surface. Further, it is preferable to apply or spray the composition.

In the method for cleaning a hard surface according to the present invention, the liquid detergent composition for hard surfaces is contacted with a hard surface, and the hard surface is then left standing for preferably 10 seconds or more, more preferably 20 seconds or more, further preferably 30 seconds or more, furthermore preferably 40 seconds or more from the viewpoint of enhancing detergency, and preferably 60 minutes or less, more preferably 30 minutes or less, further preferably 20 minutes or less, furthermore preferably 10 minutes or less, furthermore preferably 5 minutes or less from the same viewpoint. In this case, the hard surface may start being left standing at the point of first contacting the composition with the hard surface. The temperature at the time of leaving the hard surface standing may be room temperature, and is, for example, 10° C. or higher and 30° C. or lower.

In the method for cleaning a hard surface according to the present invention, a hard surface stained with oil spots and the like including a degenerated oil, a particularly thermally degenerated oil, may be immersed in the liquid detergent composition for hard surfaces to contact the composition with the hard surface, but from the viewpoint of efficiently enhancing detergency, a method is preferable in which the composition is sprayed or applied to contact the composition with a hard surface stained with oil spots and the like including a degenerated oil, particularly a thermally degenerated oil. The method for contacting the liquid detergent composition for hard surfaces with a hard surface stained with oil spots and the like is preferably spraying or application, and a method is preferable in which the composition is sprayed in the form of liquid droplets or applied in the form of foam. Specifically, spray means is used. That is, it is preferable to use a detergent article for hard surfaces in which a container with a sprayer is filled with the liquid detergent composition for hard surfaces according to the present invention. The present invention provides a spray container-housed detergent article for hard surfaces in which a container with a sprayer is filled with the liquid detergent composition for hard surfaces according to the present invention.

Examples of the container with a sprayer, which is filled with the liquid detergent composition for hard surfaces according to the present invention, in spray container-housed detergent article for hard surfaces according to the present invention, include manual spray devices which do not use a propellant, such as trigger-type spray containers and pump-type spray containers; and aerosols using a propellant. The container with a sprayer is preferably a trigger-type spray capable of spraying or applying contents in the form of liquid drops or foam, more preferably a trigger-type spray having a mechanism for spraying contents in the form of liquid droplets, or a trigger-type spray having a mechanism for forming foam (foam forming mechanism).

When a trigger-type spray having a mechanism for spraying the liquid detergent composition for hard surfaces according to the present invention in the form of liquid droplets is used in the spray container-housed detergent article for hard surfaces according to the present invention, the nozzle hole diameter of the spray nozzle of the spray container housing the composition is in the range of preferably 0.1 mm or more, more preferably 0.3 mm or more, and preferably 2 mm or less, more preferably 1 mm or less from the viewpoint of easiness of the composition to be sprayed, the diameter of the sprayed liquid droplets, or the area over which the composition is sprayed. When a trigger-type spray having a mechanism for spraying the composition in the form of liquid droplets is used, the spray container-housed detergent article for hard surfaces according to the present invention sprays the composition in an amount of preferably 0.1 mL or more, more preferably 0.3 mL or more, and preferably 5 mL or less, more preferably 2 mL or less in one operation.

When a trigger-type spray having a foam forming mechanism is used, the spray container-housed detergent article for hard surfaces according to the present invention sprays the composition in an amount of preferably 0.5 mL or more, more preferably 1 mL or more, and preferably 30 mL or less, more preferably 15 mL or less, further preferably 5 mL or less in one operation.

The method for cleaning a hard surface according to the present invention is preferable as a method for cleaning a hard surface of a hard article, and moreover a hard surface of a food processing installation and/or a cooking installation. Further, the method according to the present invention is preferable as a method for cleaning a hard surface of a hard article by hand, and moreover a method for cleaning a hard surface of a food processing installation and/or a cooking installation by hand.

The method for cleaning a hard surface according to the present invention is targeted at a hard surface of a hard article, preferably a hard surface of a food processing installation and/or a cooking installation. Examples of the hard article, and the food processing installation and/or the cooking installation include those described above. Examples of the materials of hard surfaces to be cleaned by the method for cleaning a hard surface according to the present invention include plastics (including silicone resins), metals, ceramics, wood and combinations thereof. The method for cleaning a hard surface according to the present invention is capable of effectively cleaning oil spots adhered to the hard surfaces and including a degenerated oil, particularly a thermally degenerated oil.

In the method for cleaning a hard surface according to the present invention, preferably, the liquid detergent composition for hard surfaces according to the present invention is directly contacted with a hard surface. The hard surface may be left standing in a state of being in contact with the composition, and therefore operation of exerting an external force such as a mechanical force as in scrubbing cleaning with a flexible material such as a sponge during cleaning is not necessary. The method for cleaning a hard surface according to the present invention may include a step of rinsing a hard surface with water after contacting the liquid detergent composition for hard surfaces with the hard surface, preferably a step of rinsing a hard surface with water after leaving the hard surface standing after contacting the liquid detergent composition for hard surfaces with the hard surface.

With respect to the embodiments described above, the present invention further discloses the following liquid detergent compositions for hard surfaces, and the following methods for cleaning a hard surface. To these aspects, the matters described for the liquid detergent compositions for hard surfaces and the methods for cleaning a hard surface according to the present invention may be appropriately applied in a reciprocal manner.

<1X>

A liquid detergent composition for hard surfaces which contains (a1) an amine oxide-type surfactant having at least one alkyl group or alkenyl group with 13 or more and 18 or less carbons [hereinafter, referred to as component (a1)]; and (b1) a sorbitan fatty acid ester in which the fatty acid residue has 10 or more and 18 or less carbons [hereinafter, referred to as component (b1)]; and water, wherein the mass ratio of the content of component (a1) to the content of component (b1), (a1)/(b1), is 0.4 or more.

<2X>

The liquid detergent composition for hard surfaces according to <1X>, wherein component (a1) is an amine oxide having one alkyl group or alkenyl group with 13 or more and 18 or less carbons, preferably an amine oxide having one alkyl group with 13 or more and 18 or less carbons, more preferably an amine oxide having one alkyl group with 13 or more and 16 or less carbons, further preferably an amine oxide having one alkyl group with 14 carbons.

<3X>

The liquid detergent composition for hard surfaces according to <1X>, wherein component (a1) is a compound represented by general formula (a1) below:

[Formula 3]

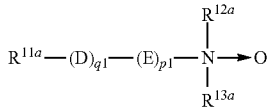

(a1)

wherein $R^{11a}$ represents an alkyl group or an alkenyl group having 13 or more and 18 or less carbons, and $R^{12a}$ and $R^{13a}$ each independently represent an alkyl group having 1 or more and 3 or less carbons; D represents a —NHC(═O)— group or a —C(═O)NH— group, and E represents an alkylene group having 1 or more and 5 or less carbons; and q1 and p1 represent that q1=0 and p1=0, or q1=1 and p1=1.

<4X>

The liquid detergent composition for hard surfaces according to any one of <1X> to <3X>, wherein the liquid detergent composition for hard surfaces contains component (a1) in an amount of preferably 0.01% by mass or more, more preferably 0.05% by mass or more, further preferably 0.1% by mass or more, furthermore preferably 0.2% by mass or more, furthermore preferably 0.3% by mass or more, furthermore preferably 0.5% by mass or more, and preferably 20% by mass or less, more preferably 10% by mass or less, further preferably 8% by mass or less, furthermore preferably 6% by mass or less, furthermore preferably 5% by mass or less, furthermore preferably 4% by mass or less, furthermore preferably 2% by mass or less.

<5X>

The liquid detergent composition for hard surfaces according to any one of <1X> to <4X>, wherein the content of component (a1) is preferably 50% by mass or more, more preferably 70% by mass or more, further preferably 80% by mass or more, furthermore preferably 90% by mass or more, and preferably 100% by mass or less in the amine oxide having at least one alkyl group or alkenyl group with 8 or more and 24 or less carbons.

<6X>

The liquid detergent composition for hard surfaces according to any one of <1X> to <4X>, wherein the content of component (a1) is 100% by mass in the amine oxide having at least one alkyl group or alkenyl group with 8 or more and 24 or less carbons.

<7X>

The liquid detergent composition for hard surfaces according to any one of <1X> to <6X>, wherein component (b1) is one or more kinds selected from a triester structure, a diester structure and a monoester structure.

<8X>

The liquid detergent composition for hard surfaces according to any one of <1X> to <7X>, wherein the number of carbons in the fatty acid residue of component (b1) is 10 or more, preferably 12 or more, more preferably 14 or more, further preferably 16 or more, and 18 or less.

<9X>

The liquid detergent composition for hard surfaces according to any one of <1X> to <7X>, wherein the number of carbons in the fatty acid residue of component (b1) is 18.

<10X>

The liquid detergent composition for hard surfaces according to any one of <1X> to <9X>, wherein the liquid detergent composition for hard surfaces contains component (b1) in an amount of preferably 0.01% by mass or more, more preferably 0.05% by mass or more, further preferably 0.1% by mass or more, furthermore preferably 0.2% by mass or more, furthermore preferably 0.3% by mass or more, furthermore preferably 0.5% by mass or more, and preferably 20% by mass or less, more preferably 10% by mass or less, further preferably 8% by mass or less, furthermore preferably 6% by mass or less, furthermore preferably 5% by mass or less, furthermore preferably 4% by mass or less, furthermore preferably 2% by mass or less.

<11x>

The liquid detergent composition for hard surfaces according to any one of <1X> to <10X>, wherein the content of component (b1) is 50% by mass or more, preferably 60% by mass or more, more preferably 70% by mass or more, further preferably 80% by mass or more, furthermore preferably 90% by mass or more, and preferably 100% by mass of less in the sorbitan fatty acid ester in which the fatty acid residue has 8 or more and 24 or less carbons.

<12X>

The liquid detergent composition for hard surfaces according to any one of <1X> to <11X>, wherein the mass ratio of the content of component (a1) to the content of component (b1), (a1)/(b1), is 0.4 or more, preferably 0.6 or more, more preferably 0.7 or more, further preferably 0.8 or more, and preferably 20 or less, more preferably 15 or less, further preferably 12 or less, furthermore preferably 10 or less, furthermore preferably 8 or less, furthermore preferably 7 or less.

<13X>

The liquid detergent composition for hard surfaces according to any one of <1X> to <12X>, wherein the total content of the content of component (a1) and the content of component (b1) is preferably 0.02% by mass or more, more preferably 0.1% by mass or more, further preferably 0.5% by mass or more, furthermore preferably 0.8 or more, furthermore preferably 1% by mass or more, and preferably 40% by mass or less, more preferably 30% by mass or less, further preferably 20% by mass or less, furthermore preferably 10% by mass or less, furthermore preferably 5% by mass or less, furthermore preferably 4% by mass or less, furthermore preferably 2% by mass or less, furthermore preferably 1.5% by mass or less.

<14X>

The liquid detergent composition for hard surfaces according to any one of <1X> to <13X>, wherein the content of surfactant other than component (a1) and component (b1) is preferably less than 5% by mass, more preferably less than 3% by mass, further preferably less than 1% by mass.

<15X>

The liquid detergent composition for hard surfaces according to any one of <1X> to <13X>, wherein the content of surfactant other than component (a1) and component (b1) is 0% by mass.

<16X>

The liquid detergent composition for hard surfaces according to any one of <1X> to <15X>, wherein the total content of the content of component (a1) and the content of component (b1) is preferably 50% by mass or more, more preferably 60% by mass or more, further preferably 80% by mass or more, furthermore preferably 90% by mass or more, and preferably 100% by mass or less in all surfactants.

<17X>

The liquid detergent composition for hard surfaces according to any one of <1X> to <15X>, wherein the total content of the content of component (a1) and the content of component (b1) is 100% by mass in all surfactants.

<18X>

The liquid detergent composition for hard surfaces according to any one of <1X> to <17X>, wherein a compound represented by general formula (c1) below is contained as component (c):

$$R^{1c}—O—(R^{2c}O)_t—H \quad (c1)$$

wherein $R^{1c}$ is a hydrocarbon group having 1 or more and 8 or less carbons, $R^{2c}O$ is an alkyleneoxy group having 2 or more and 3 or less carbons, and t is the number of added moles of $R^{2c}O$, and a number of 1 or more and 3 or less.

<19X>

The liquid detergent composition for hard surfaces according to <18X>, wherein the mass ratio of the total content of component (a1) and component (b1) to the content of component (c), [(a1)+(b1)]/(c), is preferably 1 or more, more preferably 3 or more, further preferably 5 or more, and preferably 30 or less, more preferably 20 or less, further preferably 10 or less.

<20X>

The liquid detergent composition for hard surfaces according to any one of <1X> to <19X>, wherein the liquid detergent composition for hard surfaces has a pH at 25° C. of preferably 5 or more, more preferably 5.5 or more, further preferably 6 or more, and preferably 9 or less, more preferably 8.5 or less, further preferably 8 or less.

<21X>

The liquid detergent composition for hard surfaces according to any one of <1X> to <20X>, wherein the liquid detergent composition for hard surfaces is intended for hard surfaces of a hard article, and moreover a hard surface of a food processing installation or a cooking installation.

<22X>

A method for cleaning a hard surface in which the liquid detergent composition for hard surfaces according to any one of <1X> to <21X> is contacted with a hard surface stained with oil spots including a degenerated oil, and furthermore a thermally degenerated oil.

<23X>

The method for cleaning a hard surface according to <22X>, wherein after the liquid detergent composition for hard surfaces is brought into contact with the hard surface, the hard surface is left standing for preferably 10 seconds or more, more preferably 20 seconds or more, further preferably 30 seconds or more, furthermore preferably 40 seconds or more, and preferably 60 minutes or less, more preferably 30 minutes or less, further preferably 20 minutes or less, furthermore preferably 10 minutes or less, furthermore preferably 5 minutes or less.

<24X>

The method for cleaning a hard surface according to <22X> or <23X>, wherein the method in which the liquid detergent composition for hard surfaces is contacted with the hard surface is a method in which the composition is sprayed in the form of liquid droplets, or a method in which the composition is applied in the form of foam.

<1Y>

A liquid detergent composition for hard surfaces which contains a surfactant in an amount of 0.1% by mass or more and 20% by mass or less; and water, wherein the liquid detergent composition contains, as the surfactant, (a2) an amine oxide-type surfactant having at least one alkyl group or alkenyl group with 7 or more and 12 or less carbons [hereinafter, referred to as component (a2)] and (b2) a glycerin fatty acid ester in which the fatty acid residue has 10 or more and 18 or less carbons [hereinafter, referred to as component (b2)], and wherein in the surfactant, the total content of the content of component (a2) and the content of component (b2) is 40% by mass or more.

<2Y>

The liquid detergent composition for hard surfaces according to <1Y>, wherein the liquid detergent composition for hard surfaces contains the surfactant in an amount of 0.1% by mass or more, preferably 0.5% by mass or more, more preferably 1% by mass or more, further preferably 2% by mass or more, furthermore preferably 2.5% by mass or more, and 20% by mass or less, preferably 15% by mass or less, more preferably 10% by mass or less, further preferably 8% by mass or less, furthermore preferably 6% by mass or less, furthermore preferably 4% by mass or less.

<3Y>

The liquid detergent composition for hard surfaces according to <1Y> or <2Y>, wherein component (a2) is an amine oxide having one alkyl group or alkenyl group with 7 or more and 12 or less carbons, preferably an amine oxide having one alkyl group with 7 or more and 12 or less carbons, more preferably an amine oxide having one alkyl group with 9 or more and 12 or less carbons, further preferably an amine oxide having one alkyl group with 12 carbons.

<4Y>

The liquid detergent composition for hard surfaces according to <1Y> or <2Y>, wherein component (a2) is a compound represented by general formula (a2) below:

[Formula 4]

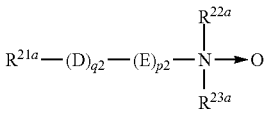

(a2)

wherein $R^{21a}$ represents an alkyl group or an alkenyl group having 7 or more and 12 or less carbons, and $R^{22a}$ and $R^{23a}$ each independently represent an alkyl group having 1 or more and 3 or less carbons; D represents a —NHC(=O)— group or a —C(=O)NH— group, and E represents an alkylene group having 1 or more and 5 or less carbons. q2 and p2 represent that q2=0 and p2=0, or q2=1 and p2=1.

<5Y>

The liquid detergent composition for hard surfaces according to any one of <1Y> to <4Y>, wherein the liquid detergent composition for hard surfaces contains component (a2) in an amount of preferably 0.05% by mass or more, more preferably 0.25% by mass or more, further preferably 0.5% by mass or more, furthermore preferably 1% by mass or more, furthermore preferably 1.25% by mass or more, and preferably 10% by mass or less, more preferably 7.5% by mass or less, further preferably 5% by mass or less, furthermore preferably 4% by mass or less, furthermore preferably 3% by mass or less, furthermore preferably 2% by mass or less.

<6Y>

The liquid detergent composition for hard surfaces according to any one of <1Y> to <5Y>, wherein the content of component (a2) is preferably 50% by mass or more, more preferably 70% by mass or more, further preferably 80% by mass or more, furthermore preferably 90% by mass or more, and preferably 100% by mass or less in the amine oxide having at least one alkyl group or alkenyl group with 8 or more and 24 or less carbons.

<7Y>

The liquid detergent composition for hard surfaces according to any one of <1Y> to <5Y>, wherein the content of component (a2) is 100% by mass in the amine oxide having at least one alkyl group or alkenyl group with 8 or more and 24 or less carbons.

<8Y>

The liquid detergent composition for hard surfaces according to any one of <1Y> to <7Y>, wherein component (b2) is one or more kinds selected from a triester structure, a diester structure and a monoester structure, preferably a monoester structure.

<9Y>

The liquid detergent composition for hard surfaces according to any one of <1Y> to <8Y>, wherein the number of carbons in the fatty acid residue of component (b2) is 10 or more, preferably 12 or more, more preferably 14 or more, and 18 or less.

<10Y>

The liquid detergent composition for hard surfaces according to any one of <1Y> to <8Y>, wherein the number of carbons in the fatty acid residue of component (b2) is 18.

<11Y>

The liquid detergent composition for hard surfaces according to any one of <1Y> to <10Y>, wherein the liquid detergent composition for hard surfaces contains component (b2) in an amount of preferably 0.05% by mass or more, more preferably 0.25% by mass or more, further preferably 0.5% by mass or more, furthermore preferably 1% by mass or more, furthermore preferably 1.25% by mass or more, and preferably 10% by mass or less, more preferably 7.5% by mass or less, further preferably 5% by mass or less, furthermore preferably 4% by mass or less, furthermore preferably 3% by mass or less, furthermore preferably 2% by mass or less.

<12Y>

The liquid detergent composition for hard surfaces according to any one of <1Y> to <11Y>, wherein the content of component (b2) is 50% by mass or more, preferably 60% by mass or more, more preferably 70% by mass or more, further preferably 80% by mass or more, furthermore preferably 90% by mass or more, and preferably 100% by mass or less in the glycerin fatty acid ester in which the fatty acid residue has 8 or more and 24 or less carbons.

<13Y>

The liquid detergent composition for hard surfaces according to any one of <1Y> to <11Y>, wherein the content of component (b2) is 100% by mass in the glycerin fatty acid ester in which the fatty acid residue has 8 or more and 24 or less carbons.

<14Y>

The liquid detergent composition for hard surfaces according to any one of <1Y> to <13Y>, wherein the mass ratio of the content of component (a2) to the content of component (b2), (a2)/(b2), is preferably 0.4 or more, more preferably 0.7 or more, further preferably 1 or more, and preferably 20 or less, more preferably 15 or less, further preferably 12 or less, furthermore preferably 10 or less, furthermore preferably 8 or less, furthermore preferably 7 or less, furthermore preferably 5 or less, furthermore preferably 2 or less.

<15Y>

The liquid detergent composition for hard surfaces according to any one of <1Y> to <14Y>, wherein the total content of the content of component (a2) and the content of component (b2) is preferably 0.1% by mass or more, more preferably 0.5% by mass or more, further preferably 1% by mass or more, furthermore preferably 1.5% by mass or more, furthermore preferably 2% by mass or more, furthermore preferably 2.5% by mass or more, and preferably 20% by mass or less, more preferably 15% by mass or less, further preferably 10% by mass or less, furthermore preferably 8% by mass or less, furthermore preferably 6% by mass or less, furthermore preferably 4% by mass or less.

<16Y>

The liquid detergent composition for hard surfaces according to any one of <1Y> to <15Y>, wherein an alkyl glycoside-type surfactant in which the alkyl group has 10 or more and 14 or less carbons is contained as a surfactant other than component (a2) and component (b2).

<17Y>

The liquid detergent composition for hard surfaces according to any one of <1Y> to <16Y>, wherein the content of a surfactant other than component (a2) and component (b2) is preferably less than 5% by mass, more preferably less than 3% by mass, further preferably less than 1% by mass.

<18Y>

The liquid detergent composition for hard surfaces according to any one of <1Y> to <15Y>, wherein the content of a surfactant other than component (a2) and component (b2) is 0% by mass.

<19Y>

The liquid detergent composition for hard surfaces according to any one of <1Y> to <16Y>, wherein the total content of the content of component (a2) and the content of component (b2) in surfactants, [(((a2)+(b2))/surfactant)×100], is 40% by mass or more, preferably 50% by mass or more, more preferably 60% by mass or more, further preferably 80% by mass or more, furthermore preferably 90% by mass or more, and preferably 100% by mass or less.

<20Y>

The liquid detergent composition for hard surfaces according to any one of <1Y> to <15Y>, wherein the total content of the content of component (a2) and the content of component (b2) in surfactants, [(((a2)+(b2))/surfactant)×100], is 100% by mass.

<21Y>

The liquid detergent composition for hard surfaces according to any one of <1Y> to <20Y>, wherein a compound represented by general formula (c1) below is contained as component (c):

$$R^{1c}—O—(R^{2c}O)_t—H \quad (c1)$$

wherein $R^{1c}$ is a hydrocarbon group having 1 or more and 8 or less carbons, $R^{2c}O$ is an alkyleneoxy group having 2 or more and 3 or less carbons, and t is the number of added moles of $R^{2c}O$, and a number of 1 or more and 3 or less.

<22Y>

The liquid detergent composition for hard surfaces according to <21Y>, wherein the mass ratio of the total content of component (a2) and component (b2) to the content of component (c), [(a2)+(b2)]/(c), is preferably 1 or more, more preferably 3 or more, further preferably 5 or more, and preferably 40 or less, more preferably 30 or less, further preferably 20 or less, furthermore preferably 10 or less.

<23Y>

The liquid detergent composition for hard surfaces according to any one of <1Y> to <22Y>, wherein the liquid detergent composition for hard surfaces has a pH at 25° C. of preferably 5 or more, more preferably 5.5 or more, further preferably 6 or more, and preferably 9 or less, more preferably 8.5 or less, further preferably 8 or less.

<24Y>

The liquid detergent composition for hard surfaces according to any one of <1Y> to <23Y>, wherein the liquid detergent composition for hard surfaces is intended for hard surfaces of a hard article, and moreover a hard surface of a food processing installation or a cooking installation.

<25Y>

A method for cleaning a hard surface in which the liquid detergent composition for hard surfaces according to any one of <1Y> to <24Y> is contacted with a hard surface stained with oil spots including a degenerated oil, and furthermore a thermally degenerated oil.

<26Y>

The method for cleaning a hard surface according to <25Y>, wherein after the liquid detergent composition for hard surfaces is brought into contact with the hard surface, the hard surface is left standing for preferably 10 seconds or more, more preferably 20 seconds or more, further preferably 30 seconds or more, furthermore preferably 40 seconds or more, and preferably 60 minutes or less, more preferably 30 minutes or less, further preferably 20 minutes or less, furthermore preferably 10 minutes or less, furthermore preferably 5 minutes or less.

<26Y>

The method for cleaning a hard surface according to <25Y> or <26Y>, wherein the method in which the liquid detergent composition for hard surfaces is contacted with the hard surface is a method in which the composition is sprayed in the form of liquid droplets, or a method in which the composition is applied in the form of foam.

EXAMPLES

Example 1, Comparative Example 1

Liquid detergent compositions for hard surfaces as shown in Table 1 were prepared using the following ingredients, and evaluated for the following items. The results are shown in Table 1. The liquid detergent compositions for hard surfaces in Table 1 were prepared by a normal method. Specifically, component (a1) or component (a1'), and component (b1) were added to an appropriate amount of ion-exchanged water, the resulting mixture was warmed and dissolved at 60° C., and then brought back to room temperature (25° C.), and sodium hydroxide and/or hydrochloric acid was added to adjust the pH (25° C.) to 7. All of the ratios (% by mass) of the ingredients in Table 1 were values based on effective contents.

<Ingredients>

Component (a1)

Myristyl dimethylamine oxide: AMPHITOL 40N (manufactured by Kao Corporation), compound of general formula (a1) in which $R^{11a}$ is a myristyl group, each of $R^{12a}$ and $R^{13a}$ is a methyl group, and q1=0 and p1=0.

Component (a1') (Comparative Component for component (a1))

Lauryl dimethylamine oxide: AMPHITOL 20N (manufactured by Kao Corporation), compound of general formula (a1) in which $R^{11a}$ is a lauryl group, each of $R^{12a}$ and $R^{13a}$ is a methyl group, and q1=0 and p1=0.

Component (b1)

Sorbitan trioleate: RHEODOL SP-030V (manufactured by Kao Corporation)

Sorbitan monostearate: RHEODOL SP-S10V (manufactured by Kao Corporation)

Sorbitan monopalmitate: RHEODOL SP-P10 (manufactured by Kao Corporation)

Sorbitan monolaurate: RHEODOL SP-L10 (manufactured by Kao Corporation)

[Evaluation of Detergency Against Thermally Degenerated Oil]

Rapeseed oil (manufactured by Wako Pure Chemical Industries Co., Ltd.) was heated in stationary state at 180° C. for 8 hours to prepare a thermally degenerated oil. Each thermally degenerated oil was applied in an amount of about 1 mg/cm$^2$ to a test piece (manufactured by Engineering Test Service, SUS 304, 1 mm×25 mm×70 mm) weighed (x) beforehand using a four-decimal-place electronic balance, and the test piece was then weighed (y) using the four-decimal-place balance.

2 ml of each of the liquid detergent compositions for hard surfaces was sprayed in the form of foam to the coated test piece using a pump foamer (for Biore Hand Wash, manufactured by Kao Corporation), and the test piece was placed flat and left standing for 20 minutes. The test piece cleaned for 20 minutes was rinsed with tap water at 25° C. for 1 minute using a Leenerts tester (the amount of water was 700 ml and the rotation speed of the rotor was 300 rpm). After the rinsing, the test piece was dried in air overnight, and the mass of the cleaned test piece was weighed (z) with the four-decimal-place electronic balance.

The cleaning rate was determined from the equation below. The results of cleaning rates in the case of applying a thermally degenerated oil heated for 8 hours are shown in Table 1.

$$\text{cleaning rate (\%)}=\{(y)-(z)\}/\{(y)-(x)\}\times 100$$

TABLE 1

| | | | | Example 1 | | | | | | |
|---|---|---|---|---|---|---|---|---|---|---|
| | | | | 1-1 | 1-2 | 1-3 | 1-4 | 1-5 | 1-6 | 1-7 |
| Liquid detergent composition for hard surfaces | Formulation (% by mass) | (a1) | Myristyl dimethylamine oxide | 1.00 | 0.50 | 1.75 | 1.50 | 0.90 | 1.00 | 1.00 |
| | | (a1') | Lauryl dimethylamine oxide | | | | | | | |
| | | (b1) | Sorbitan trioleate | 1.00 | 0.50 | 0.25 | 0.50 | 1.10 | | |
| | | | Sorbitan monostearate | | | | | | 1.00 | |
| | | | Sorbitan monopalmitate | | | | | | | 1.00 |
| | | | Sorbitan monolaurate | | | | | | | |
| | | | Water | Balance | Balance | Balance | Balance | Balance | Balance | Balance |
| | | | Total | 100 | 100 | 100 | 100 | 100 | 100 | 100 |
| | | | pH (25° C.) | 7 | 7 | 7 | 7 | 7 | 7 | 7 |
| | | | (a1)/(b1)(mass ratio) | 1.0 | 1.0 | 7.0 | 3.0 | 0.8 | 1.0 | 1.0 |
| | Evaluation item | | Cleaning rate (%) against thermally denatured oil (8 hours) | 92.8 | 93.7 | 91.1 | 86.6 | 96.5 | 92.8 | 88.6 |

| | | | | Example 1 | Comparative Example 1 | | | |
|---|---|---|---|---|---|---|---|---|
| | | | | 1-8 | 1-1 | 1-2 | 1-3 | 1-4 |
| Liquid detergent composition for hard surfaces | Formulation (% by mass) | (a1) | Myristyl dimethylamine oxide | 1.00 | 2.00 | | 0.50 | 0.25 |
| | | (a1') | Lauryl dimethylamine oxide | | | 1.00 | | |
| | | (b1) | Sorbitan trioleate | | | 1.00 | 1.50 | 0.75 |
| | | | Sorbitan monostearate | | | | | |
| | | | Sorbitan monopalmitate | | | | | |
| | | | Sorbitan monolaurate | 1.00 | | | | |
| | | | Water | Balance | Balance | Balance | Balance | Balance |
| | | | Total | 100 | 100 | 100 | 100 | 100 |
| | | | pH (25° C.) | 7 | 7 | 7 | 7 | 7 |
| | | | (a1)/(b1)(mass ratio) | 1.0 | — | — | 0.3 | 0.3 |
| | Evaluation item | | Cleaning rate (%) against thermally denatured oil (8 hours) | 71.4 | 69.0 | 57.7 | 13.8 | 41.9 |

Example 2 and Comparative Example 2

Liquid detergent compositions for hard surfaces as shown in Tables 2 and 3 were prepared using the following ingredients, and evaluated for the following items. The results are shown in Tables 2 and 3. The liquid detergent compositions for hard surfaces in Tables 2 and 3 were prepared by a normal method. Specifically, component (a2), component (a2'), component (b2), component (c), other surfactants and a preservative were added to an appropriate amount of ion-exchanged water, the resulting mixture was warmed and dissolved at 60° C., and then brought back to room temperature (25° C.), and sodium hydroxide and/or hydrochloric acid was added to adjust the pH (25° C.) to 7. All of the ratios (% by mass) of the ingredients in Tables 2 and 3 were values based on effective contents.

<Ingredients>

Component (a2)

Lauryl dimethylamine oxide: AMPHITOL 20N (manufactured by Kao Corporation), compound of general formula (a2) in which $R^{21a}$ is a lauryl group, each of $R^{22a}$ and $R^{23a}$ is a methyl group, and q2=0 and p2=0.

Component (a2') (comparative component for component (a2))

Myristyl dimethylamine oxide: AMPHITOL 40N (manufactured by Kao Corporation), compound of general formula (a2) in which $R^{21a}$ is a myristyl group, each of $R^{22a}$ and $R^{23a}$ is a methyl group, and q2=0 and p2=0.

Component (b2)

Glyceride monooleate: EXCEL 0-95R (manufactured by Kao Corporation)

Glyceride monopalmitate: manufactured by Wako Pure Chemical Industries Co., Ltd., reagent Glyceride monolaurate: manufactured by Wako Pure Chemical Industries Co., Ltd., reagent Glyceride monocaprate: manufactured by Wako Pure Chemical Industries Co., Ltd., reagent Glyceride monostearate: manufactured by Wako Pure Chemical Industries Co., Ltd., reagent Other Surfactants Alkyl glycoside: MYDOL 12 (manufactured by Kao Corporation)

Polyoxyethylene (12) lauryl ether: value in the parentheses is an average number of added moles of an oxyethylene group Polyoxyethylene (3) sodium lauryl sulfate: value in the parentheses is an average number of added moles of an oxyethylene group Component (c)

BDG-NS: 2-(2-n-butoxyethoxy)ethanol, manufactured by Nippon Nyukazai Co., Ltd.

MFG: 1-methoxy-2-propanol, manufactured by Nippon Nyukazai Co., Ltd.

MFDG: dipropylene glycol monomethyl ether, manufactured by Nippon Nyukazai Co., Ltd.

HeDG: 2-(2-hexyloxyethoxy)ethanol, manufactured by Nippon Nyukazai Co., Ltd.

PhG: 2-phenoxyethanol, manufactured by Nippon Nyukazai Co., Ltd.

Other Components

Preservative 1: 5-chloro-2-methyl-4-isothiazolin-3-one, KATHON CG (100-fold dilution), manufactured by Rohm & Haas Japan K.K.

Preservative 2: 1,2-benzisothiazolin-3-one, PROXEL BDN, manufactured by Lonza Japan

[Evaluation of Detergency Against Thermally Degenerated Oil]

For the liquid detergent compositions for hard surfaces as shown in Table 2, the cleaning rates of the liquid detergent compositions for hard surfaces were determined by the same method as described in evaluation of detergency against a thermally degenerated oil in Example 1 and Comparative Example 1. The results are shown in Table 2.

TABLE 2

| | | | | Example 2 | | | | | | | | |
|---|---|---|---|---|---|---|---|---|---|---|---|---|
| | | | | 2-1 | 2-2 | 2-3 | 2-4 | 2-5 | 2-6 | 2-7 | 2-8 | 2-0 |
| Liquid detergent composition for hard surfaces | Formulation (% by mass) | (a2) | Lauryl dimethylamine oxide | 1.00 | 0.50 | 1.75 | 1.50 | 0.90 | 1.00 | 1.00 | 1.00 | 1.00 |
| | | (a2') | Myristyl dimethylamine oxide | | | | | | | | | |
| | | (b2) | Glyceride monooleate | 1.00 | 0.50 | 0.25 | 0.50 | 1.10 | | | | |
| | | | Glyceride monopalmitate | | | | | | 1.00 | | | |
| | | | Glyceride monolaurate | | | | | | | 1.00 | | |
| | | | Glyceride monocaprate | | | | | | | | 1.00 | |
| | | | Glyceride monostearate | | | | | | | | | 1.00 |
| | | | Alkyl glycoside | | | | | | | | | |
| | | | Polyoxyethylene (12) lauryl ether | | | | | | | | | |
| | | | Polyoxyethylene (3) sodium lauryl sulfate | | | | | | | | | |
| | | | Water | Balance | Balance | Balance | Balance | Balance | Balance | Balance | Balance | Balance |
| | | | Total | 100 | 100 | 100 | 100 | 100 | 100 | 100 | 100 | 100 |
| | | | pH (25° C.) | 7 | 7 | 7 | 7 | 7 | 7 | 7 | 7 | 7 |
| | | | (a2)/(b2)(mass ratio) | 1.0 | 1.0 | 7.0 | 3.0 | 0.8 | 1.0 | 1.0 | 1.0 | 1.0 |

TABLE 2-continued

| | | | | | | | | | | | |
|---|---|---|---|---|---|---|---|---|---|---|---|
| ((a2) + (b2))/surfactant (% by mass) | | | 100 | 100 | 100 | 100 | 100 | 100 | 100 | 100 | 100 |
| Evaluation item | Cleaning rate (%) against denatured oil (8 hours) | | 87.0 | 83.3 | 58.6 | 67.5 | 50.1 | 68.3 | 51.0 | 54.6 | 39.2 |

| | | | | Example 2 | | | | | | | |
|---|---|---|---|---|---|---|---|---|---|---|---|
| | | | | 2-10 | 2-11 | 2-12 | 2-13 | 2-14 | 2-15 | 2-16 | 2-17 |
| Liquid detergent composition for hard surfaces | Formulation (% by mass) | (a2) | Lauryl dimethylamine oxide | 1.00 | 1.00 | 1.00 | 1.50 | 1.75 | 1.85 | 1.95 | 2.00 |
| | | (a2') | Myristyl dimethylamine oxide | | | | | | | | |
| | | (b2) | Glyceride monooleate Glyceride monopalmitate Glyceride monolaurate Glyceride monocaprate Glyceride monostearate | 1.00 | 1.00 | 1.00 | 1.50 | 1.75 | 1.85 | 1.95 | 2.00 |
| | | | Alkyl glycoside | 0.10 | 0.30 | 2.00 | 1.00 | 0.50 | 0.30 | 0.10 | |
| | | | Polyoxyethylene (12) lauryl ether | | | | | | | | |
| | | | Polyoxyethylene (3) sodium lauryl sulfate | | | | | | | | |
| | | | Water | Balance | Balance | Balance | Balance | Balance | Balance | Balance | Balance |
| | | | Total | 100 | 100 | 100 | 100 | 100 | 100 | 100 | 100 |
| | | | pH (25° C.) | 7 | 7 | 7 | 7 | 7 | 7 | 7 | 7 |
| | | | (a2)/(b2)(mass ratio) | 1.0 | 1.0 | 1.0 | 1.0 | 1.0 | 1.0 | 1.0 | 1.0 |
| | | | ((a2) + (b2))/surfactant (% by mass) | 95 | 87 | 50 | 75 | 88 | 93 | 98 | 100 |
| | Evaluation item | | Cleaning rate (%) against denatured oil (8 hours) | 62.8 | 42.2 | 35.6 | 51.7 | 51.8 | 59.5 | 69.7 | 93.0 |

| | | | | Comparative Example 2 | | | | |
|---|---|---|---|---|---|---|---|---|
| | | | | 2-1 | 2-2 | 2-3 | 2-4 | 2-5 |
| Liquid detergent composition for hard surfaces | Formulation (% by mass) | (a2) | Lauryl dimethylamine oxide | | 1.00 | 1.00 | 1.00 | 0.50 |
| | | (a2') | Myristyl dimethylamine oxide | 1.00 | | | | |
| | | (b2) | Glyceride monooleate Glyceride monopalmitate Glyceride monolaurate Glyceride monocaprate Glyceride monostearate | 1.00 | 1.00 | 1.00 | 1.00 | 0.50 |
| | | | Alkyl glycoside | | 14.00 | | 5.00 | 3.00 |
| | | | Polyoxyethylene (12) lauryl ether | | | 7.00 | | |
| | | | Polyoxyethylene (3) sodium lauryl sulfate | | | 7.00 | | |
| | | | Water | Balance | Balance | Balance | Balance | Balance |
| | | | Total | 100 | 100 | 100 | 100 | 100 |
| | | | pH (25° C.) | 7 | 7 | 7 | 7 | 7 |
| | | | (a2)/(b2)(mass ratio) | 0 | 1.0 | 1.0 | 1.0 | 1.0 |
| | | | ((a2) + (b2))/surfactant (% by mass) | 50 | 13 | 13 | 29 | 25 |
| | Evaluation item | | Cleaning rate (%) against denatured oil (8 hours) | 25.6 | 27.0 | 23.4 | 30.4 | 33.3 |

[Evaluation of Appearance]

A 50 mL sample bottle (No. 6 wide-mouth standard bottle made of glass and having a cylindrical shape having a diameter of 40 mm and a height of 80 mm) was filled with each of 40 mL of the liquid detergent compositions for hard surfaces in Table 3, covered with a lid, and left standing at ordinary temperature for 0.5 hours. After the bottle was left standing, the appearance of the composition was visually observed, and assessed in accordance with the following criteria. The results are shown in Table 3.

Transparent and uniform: fine particles are not visible, and the liquid is transparent.

Very slightly cloudy: fine particles are not visible, but the liquid has slightly low optical transparency.

Slightly cloudy: fine particles are not visible, but the liquid has low optical transparency.

Cloudy and separated: fine particles are visible, and the entirety of the liquid is milky-white, or separated in two phases.

[Measurement of Viscosity]

Brookfield Viscometer: Model BM (manufactured by Tokyo Keiki Inc.) equipped with a rotor of Rotor No. 1 was prepared. A viscosity measuring beaker was filled with each of the liquid detergent compositions for hard surfaces in Table 3, and the temperature was adequately adjusted in a constant temperature water bath at 25° C. The beaker containing the composition was set in the viscometer. A value after 60 seconds of measurement at a rotor speed of 60 r/min was defined as the viscosity of the composition. The results are shown in Table 3.

(3) Evaluation of Foaming Properties 5 ml of each of the liquid detergent compositions for hard surfaces in Table 3 was sprayed in the form of foam to a vertical surface of a longitudinally placed rectangular stainless steel tray (manufactured by AS ONE Corporation, 199 mm×140 mm×18 mm) using a spray for business use (refillable spray container for business use, manufactured by Kao Corporation) (the trigger of the spray was squeezed five times). Foam quality immediately after the spraying was visually observed, and the foaming properties were evaluated according to the following assessment criteria. The results are shown in Table 3.

Assessment Criteria

Score 0: foaming did not occur.

Score 1: foaming occurred, and foam adhered to the vertical surface did not remain.

Score 2: foaming occurred, and part of foam adhered to the vertical surface remained.

Score 3: foaming occurred, and the entirety of foam adhered to the vertical surface remained.

TABLE 3

| | | | | Example 2 | | | | | |
|---|---|---|---|---|---|---|---|---|---|
| | | | | 2-18 | 2-19 | 2-20 | 2-21 | 2-22 | 2-23 |
| Liquid detergent composition for hard surfaces | Formulation (% by mass) | (a2) | Lauryl dimethylamine oxide | 7.80 | 7.80 | 7.80 | 7.80 | 7.80 | 7.80 |
| | | (b2) | Glyceride monooleate | 4.20 | 4.20 | 4.20 | 4.20 | 4.20 | 4.20 |
| | | (C) | MFG | | | | | | |
| | | | MFDG | | | | | | |
| | | | BDG-NS | 3.00 | 6.00 | 9.00 | 12.00 | 0.30 | 0.50 |
| | | | HeDG | | | | | | |
| | | | PhG | | | | | | |
| | | | Preservative 1 | 0.0002 | 0.0002 | 0.0002 | 0.0002 | 0.0002 | 0.0002 |
| | | | Preservative 2 | 0.01 | 0.01 | 0.01 | 0.01 | 0.01 | 0.01 |
| | | | Water | Balance | Balance | Balance | Balance | Balance | Balance |
| | | | Total | 100 | 100 | 100 | 100 | 100 | 100 |
| | (a2)/(b2) (mass ratio) | | | 1.9 | 1.9 | 1.9 | 1.9 | 1.9 | 1.9 |
| | [(a2) + (b2)]/(c) (mass ratio) | | | 4.0 | 2.0 | 1.3 | 1.0 | 40.0 | 24.0 |
| | pH(25° C.) | | | 7.0 | 7.0 | 7.0 | 7.0 | 7.0 | 7.0 |
| Evaluation item | Appearance | | | Transparent and uniform | Transparent and uniform | Transparent and uniform | Transparent and uniform | Transparent and uniform | Transparent and uniform |
| | Viscosity (25° C.) (mPa · s) | | | 10.3 | 7.5 | 6.6 | 6.3 | 10 | 10 |
| | Foaming property (score) | | | 3 | 3 | 3 | 3 | 1 | 2 |

| | | | | Example 2 | | | | |
|---|---|---|---|---|---|---|---|---|
| | | | | 2-24 | 2-25 | 2-26 | 2-28 | 2-29 |
| Liquid detergent composition for hard surfaces | Formulation (% by mass) | (a2) | Lauryl dimethylamine oxide | 7.80 | 7.80 | 7.80 | 7.80 | 7.80 |
| | | (b2) | Glyceride monooleate | 4.20 | 4.20 | 4.20 | 4.20 | 4.20 |
| | | (C) | MFG | | 1.00 | | | |
| | | | MFDG | | | 1.00 | | |
| | | | BDG-NS | 1.00 | | | | |
| | | | HeDG | | | | 1.00 | |
| | | | PhG | | | | | 1.00 |
| | | | Preservative 1 | 0.0002 | 0.0002 | 0.0002 | 0.0002 | 0.0002 |
| | | | Preservative 2 | 0.01 | 0.01 | 0.01 | 0.01 | 0.01 |
| | | | Water | Balance | Balance | Balance | Balance | Balance |
| | | | Total | 100 | 100 | 101 | 103 | 104 |
| | (a2)/(b2) (mass ratio) | | | 1.9 | 1.9 | 1.9 | 1.9 | 1.9 |
| | [(a2) + (b2)]/(c) (mass ratio) | | | 12.0 | 12.0 | 12.0 | 12.0 | 12.0 |
| | pH(25° C.) | | | 7.0 | 7.0 | 7.0 | 7.0 | 7.0 |

TABLE 3-continued

| Evaluation item | Appearance | Transparent and uniform | Transparent and uniform | Transparent and uniform | Transparent and uniform | Transparent and uniform |
|---|---|---|---|---|---|---|
| | Viscosity (25° C.) (mPa · s) | 10 | 10.3 | 10.3 | 10.3 | 10.3 |
| | Foaming property (score) | 3 | 1 | 3 | 3 | 2 |

The liquid detergent compositions for hard surfaces in Table 3 had a cleaning rate of 90% or more in the evaluation of detergency against the thermally degenerated oil (8 hours), and was thus satisfactory.

Formulation Examples

Table 4 shows formulation examples of the liquid detergent compositions for hard surfaces according to the present invention, which contain the component (a1), component (b1) and component (c). These liquid detergent compositions for hard surfaces have a cleaning rate of 70% or more in the evaluation of detergency against the thermally degenerated oil (8 hours), and are thus satisfactory. Further, these liquid detergent compositions for hard surfaces are uniform and transparent in the appearance evaluation, have a viscosity of 10 to 40 mPa-s at 25° C., are rated as score 3 in the foaming property evaluation, and are thus satisfactory.

TABLE 4

| | | | | Formulation examples | | | | |
|---|---|---|---|---|---|---|---|---|
| | | | | 1 | 2 | 3 | 4 | 5 |
| Liquid detergent composition for hard surfaces | Formulation (% by mass) | (a1) | Myristyl dimethylamine oxide | 5.25 | 5.25 | 5.25 | 5.25 | 5.25 |
| | | (b1) | Sorbitan monolaurate | 0.75 | 0.75 | 0.75 | 0.75 | 0.75 |
| | | (c) | MFG | 1.00 | | | | |
| | | | MFDG | | 1.00 | | | |
| | | | BDG-NS | | | 1.00 | | |
| | | | HeDG | | | | 1.00 | |
| | | | PhG | | | | | 1.00 |
| | | | Preservative 1 | 0.0002 | 0.0002 | 0.0002 | 0.0002 | 0.0002 |
| | | | Preservative 2 | 0.01 | 0.01 | 0.01 | 0.01 | 0.01 |
| | | | Water | Balance | Balance | Balance | Balance | Balance |
| | | | Total | 100 | 100 | 100 | 100 | 101 |
| | (a1)/(b1) (mass ratio) | | | 7.0 | 7.0 | 7.0 | 7.0 | 7.0 |
| | [(a1) + (b1)]/(c) (mass ratio) | | | 6.0 | 6.0 | 6.0 | 6.0 | 6.0 |
| | pH(25° C.) | | | 7.0 | 7.0 | 7.0 | 7.0 | 7.0 |

The invention claimed is:

1. A liquid detergent composition for hard surfaces comprising from 0.1 to 20% by mass of a surfactant system, and water, wherein the surfactant system comprises:

a2) an amine oxide surfactant having at least one alkyl group or alkenyl group with 7 or more and 12 or less carbons; and b2) a glycerin fatty acid ester in which the fatty acid residue is selected from the group consisting of oleic acid, palmitic acid, myristic acid, and mixtures thereof; and wherein the total content of the content of (a2) and (b2) in the surfactant system is 90% by mass or more, and wherein the mass ratio of (a2) to (b2), (a2)/(b2), is 1 or more and 20 or less.

2. The liquid detergent composition for hard surfaces according to claim 1, wherein a raw material fatty acid for the fatty acid residue of the component (b2) is oleic acid.

3. The liquid detergent composition for hard surfaces according to claim 1 comprising 0.3 to 15% by mass of a compound represented by general formula (c1) as a component (c):

$$R^{1c}—O—(R^{2c}O)_t—H \quad (c1)$$

wherein $R^{1c}$ is a hydrocarbon group having 1 or more and 8 or less carbons, $R^{2c}O$ is an alkyleneoxy group having 2 or more and 3 or less carbons, and t is the number of added moles of $R^{2c}O$, and a number of 1 or more and 3 or less.

4. The liquid detergent composition for hard surfaces according to claim 3, wherein a mass ratio of [(a2)+(b2)/(c)] is 1 or more and 40 or less.

* * * * *